US008946978B2

(12) United States Patent
Ansems et al.

(10) Patent No.: US 8,946,978 B2
(45) Date of Patent: Feb. 3, 2015

(54) LIGHTING DEVICE WITH OMNIDIRECTIONAL LIGHT DISTRIBUTION

(71) Applicant: Koninklijke Philips N.V., Eindhoven (NL)

(72) Inventors: Johannes Petrus Maria Ansems, Hulsel (NL); Joris Hubertus Antonius Hagelaar, Nuenen (NL); Peter Johannes Martinus Bukkems, Deurne (NL); Vincent Stefan David Gielen, Eindhoven (NL); Reinier Imre Anton Den Boer, Eindhoven (NL); Shi Bei He, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/352,034

(22) PCT Filed: Oct. 19, 2012

(86) PCT No.: PCT/CN2012/001405

§ 371 (c)(1),
(2) Date: Apr. 15, 2014

(87) PCT Pub. No.: WO2013/056516

PCT Pub. Date: Apr. 25, 2013

(65) Prior Publication Data

US 2014/0252942 A1 Sep. 11, 2014

Related U.S. Application Data

(60) Provisional application No. 61/548,882, filed on Oct. 19, 2011.

(51) Int. Cl.

| | |
|---|---|
| ***H01J 5/00*** | (2006.01) |
| ***F21V 5/00*** | (2006.01) |
| ***F21V 3/04*** | (2006.01) |
| ***F21K 99/00*** | (2010.01) |
| *F21V 3/00* | (2006.01) |

(52) U.S. Cl.
CPC ... *F21V 5/00* (2013.01); *F21V 3/04* (2013.01); *F21K 9/135* (2013.01); *F21V 3/005* (2013.01)
USPC ..... 313/317; 313/116

(58) Field of Classification Search
USPC ..... 313/317, 116
See application file for complete search history.

(56) References Cited

U.S. PATENT DOCUMENTS

| | | | | |
|---|---|---|---|---|
| 4,988,911 | A | 1/1991 | Miller | |
| 6,066,861 | A * | 5/2000 | Hohn et al. | 257/99 |
| 2009/0200939 | A1 * | 8/2009 | Lenk et al. | 313/512 |

FOREIGN PATENT DOCUMENTS

| | | | |
|---|---|---|---|
| CN | 101275731 | A | 5/2008 |
| CN | 202469601 | U | 10/2012 |

(Continued)

*Primary Examiner* — Mary Ellen Bowman
(74) *Attorney, Agent, or Firm* — Yuliya Mathis

(57) ABSTRACT

A lighting device (2) comprises a light source (210) having a main forward emission direction (20), and an envelope (220) in which the light source (210) is arranged. The envelope (220) comprises an upper portion (225) having scattering properties and being arranged to reflect a part of the light from the light source (210) laterally and backwardly relative to the main forward emission direction (20) and transmit a part of the light from the light source (210). The light intensity distribution of the lighting device (2) is more uniform, as backward and lateral light intensity is increased while the light in the main forward emission direction (20) is still admitted.

11 Claims, 7 Drawing Sheets

(56) References Cited

FOREIGN PATENT DOCUMENTS

| | | | |
|---|---|---|---|
| DE | 3729554 | C2 | 8/2000 |
| DE | 202010004672 | U1 | 7/2010 |
| GB | 410089 | | 5/1934 |
| GB | 426071 | | 3/1935 |
| JP | 6251755 | A | 9/1994 |
| WO | 2011109092 | A2 | 9/2011 |
| WO | 2012085853 | A1 | 6/2012 |

* cited by examiner

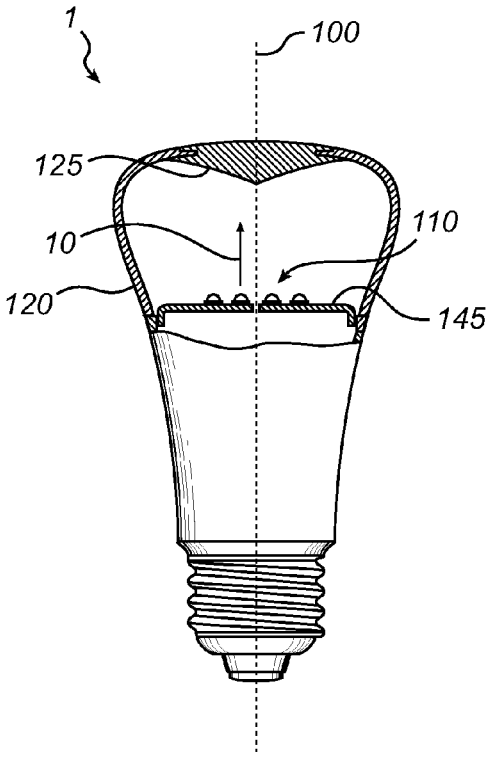
(Prior art) Fig. 1a
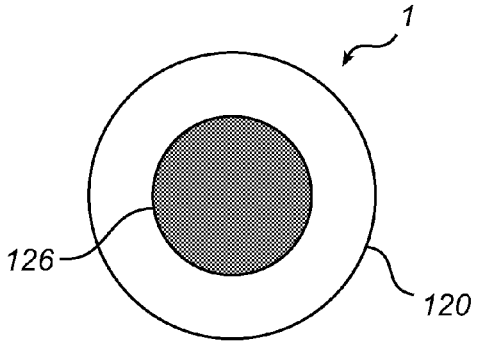
(Prior art) Fig. 1b

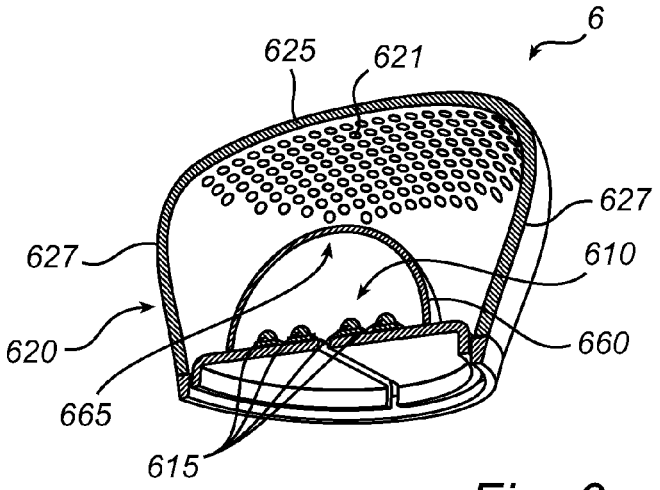
Fig. 6
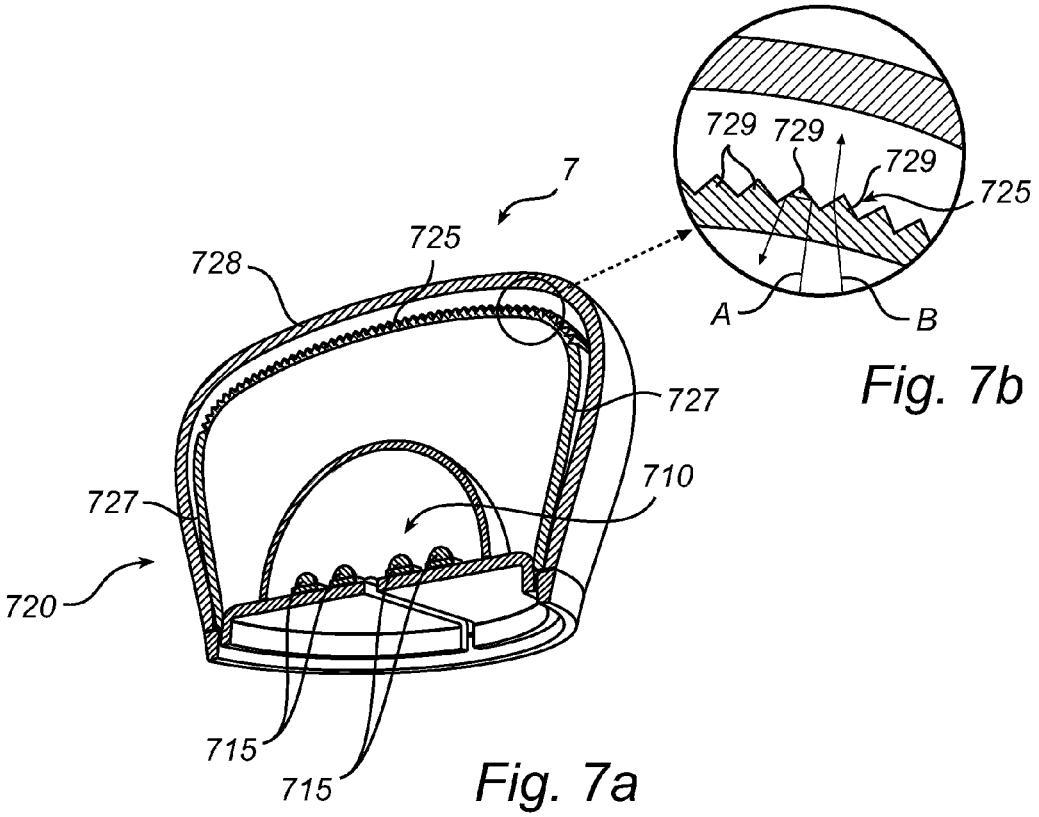
Fig. 7b
Fig. 7a

LIGHTING DEVICE WITH OMNIDIRECTIONAL LIGHT DISTRIBUTION

FIELD OF THE INVENTION

The present invention generally relates to the field of lighting devices having means for reflecting light laterally and backwardly such that an improved light intensity distribution is obtained.

BACKGROUND OF THE INVENTION

In conventional LED-based lighting devices, the light source provides a directed light with a higher light intensity forwardly than laterally and backwardly, as the base, at which the light source is mounted, shadows some of the light emitted by the light source. For obtaining a more omnidirectional light intensity distribution, and thereby better resemble a traditional incandescent light bulb, it is desirable to increase the light intensity laterally and backwardly.

CN101275731 shows an LED-based lighting device having a reflector arranged at the top of an envelope enclosing an LED. The reflector reflects some of the light from the LED laterally and backwardly for increasing the light intensity at the back of the lighting device. A problem with such lighting devices is that the reflector provides a visible dark area at the top of the envelope, as some of the light emitted from the LED in the main forward emission direction is blocked by the reflector.

SUMMARY OF THE INVENTION

It is an object of the present invention to solve these problems and provide a lighting device with a more uniform light intensity distribution. In particular, it is an object of the present invention to provide a lighting device with a reduced dark area at the top of the envelope.

These and other objects of the present invention are achieved by a lighting device as defined in the independent claim. Embodiments of the invention are defined in the dependent claims.

According to an aspect of the present invention, a lighting device is provided. The lighting device comprises a light source having a main forward emission direction, and an envelope in which the light source is arranged. The envelope comprises an upper portion having scattering properties and being arranged to reflect a part of the light from the light source laterally and backwardly relative to the main forward emission direction and transmit a part of the light from the light source.

With the present invention, the light intensity of the lighting device is increased in the lateral and backward directions, as the upper portion having scattering properties reflects (or redirects) some of the light from the light source in these directions. Further, the upper portion also transmits some of the light from the light source out of the envelope such that the upper portion (just like the remaining portion of the envelope) may appear to be luminous.

The present invention is advantageous in that the light intensity distribution is more uniform, as backward and lateral light intensity is increased while still admitting light in the main forward emission direction. Further, as the upper portion transmits some of the light instead of blocking all light, the visible dark area, as obtained in the prior art, is reduced and preferably removed. In particular for LED-based lighting devices, the LED light source provides a directed light with a higher light intensity forwardly (i.e. along the main forward emission direction) than laterally and backwardly (i.e. along a lateral direction or a backward direction relative to the main forward emission direction), which thus may be compensated by scattering a part of the light from the LED laterally and backwardly. With the present invention, the light distribution (which is more omnidirectional), as well as the appearance (with a reduced visible dark area), of the lighting device better resembles that of an incandescent light bulb.

Further, the present invention is advantageous in that the upper portion redirects part of the light by means of scattering, whereby diffuse reflection and transmittance of the light is obtained, and visible sharp edges at the transition between the upper portion and the lateral portion of the envelope, as well as in the illuminated surroundings, are reduced. The scattering in the upper portion of impinging light may diffuse the light in the forward emission direction, as light being transmitted through the upper portion also may be slightly redirected (but forwardly) due to the scattering. Hence, the diffuse reflection of the light laterally and backwardly and the diffuse transmission of light obtained by the scattering at the upper portion makes the light intensity distribution smoother both in the near field and in the far field. Another advantage of the present invention is that the scattering properties (and the upper portion) may be integrated in the envelope, thereby facilitating assembling of the lighting device during manufacturing, as fewer components are required compared to if a separate reflector is used, as in prior art techniques.

In the present disclosure, the term "upper portion of the envelope" may refer to a portion of the envelope against which light emitted substantially in the main forward emission direction from the light source impinges. Preferably, the upper portion may be the portion of the envelope arranged in front of the light source, i.e. at a location along the main forward emission direction of the light source. Further, by the term "main forward emission direction" it is meant a direction being parallel with the main optical axis of the light source and pointing away from the light source. For example, for a conventional LED, the main forward emission direction may be the emission direction at which the light intensity of the LED peaks. It will be appreciated that the light source may comprise several sub light sources, such as several LEDs, with non-parallel optical axes, wherein the main forward emission direction may be a direction being parallel with the optical axis of the group of sub light sources together and pointing away from the group of sub light sources.

According to an embodiment of the present invention, the envelope may be adapted such that scattering of light is higher in the upper portion than in a lateral portion of the envelope. Hence, a higher degree of scattering may occur in the upper portion than in the lateral portion of the envelope. The present embodiment is advantageous in that the upper portion of the envelope transmits a smaller percentage, and reflects (backwardly and laterally) a larger percentage, of impinging light (from the light source) than the lateral portion. Thus, the light intensity is increased laterally and backwardly, partly because the upper portion reflects more of the light from the light source emitted in the main forward emission direction backwardly and laterally and partly because the lateral portion transmits more of impinging light (both light emitted by the light source and light reflected by the upper portion) in the lateral and backward directions (relative to the main forward emission direction).

It will be appreciated that the lateral portion may be a portion of the envelope against which light emission in substantially lateral and backward directions (relative to the main forward emission direction) from the light source impinges. The lateral portion may also be referred to as a sidewall of the envelope.

According to an embodiment of the present invention, the upper portion may have a transmittance of at least 10%, preferably at least 25%, and even more preferably at least 50%. Hence, the upper portion may be adapted to transmit at least 10%, and preferably at least 25%, of the light impinging on the upper portion. The present embodiment is advantageous in that such transmittance through the upper portion sufficiently reduces the visibility of any dark area on top of the envelope, which gives the envelope an appearance of being more uniformly luminous and makes the light intensity distribution more uniform. Further, the upper portion may be adapted to reflect a major part of the rest of the light impinging on the upper portion backwardly and laterally (i.e. reflect the light not being transmitted out of the envelope), such as up to 90%, 75% or 50% of the light, respectively (some of the light may be absorbed in the upper portion), which is advantageous in that the light intensity distribution is more uniform and the lighting device better resembles an incandescent light bulb.

According to an embodiment of the present invention, the scattering properties (or scattering strength, magnitude or level) of the upper portion may gradually decrease towards the lateral portion of the envelope, which is advantageous in that the transition between the upper portion and the lateral portion is smoother (or less sharp). Hence, with the present embodiment, the appearance of visible edges at the transition between the upper and lateral portions at the envelope is prevented and the light intensity distribution in the near field is smoother.

According to an embodiment of the present invention, the upper portion may comprise scattering particles. The scattering particles provide the upper portion its scattering properties and are adapted to scatter light impinging on the upper portion. Optionally, also the lateral portion (or the remaining portion) of the envelope may comprise scattering particles, which may be advantageous in that light from the light source emitted in the lateral and backward directions is diffused, which reduces glaring light from the light source.

In an embodiment, the concentration of the scattering particles may be higher in the upper portion of the envelope than in the lateral portion of the envelope. Hence, the light intensity distribution of the lighting device may be tuned by varying the concentration of scattering particles across the envelope. The higher concentration of scattering particles in the upper portion provides an increased reflection of light to the lateral and backward directions.

In embodiments, the scattering particles may be arranged at an inner surface of the envelope, whereby reflection of light backwardly and laterally is obtained by surface scattering at the upper portion. For example, the inner surface of the upper portion may be coated with scattering particles. Optionally, scattering particles may also be arranged at the inner surface of the lateral portions of the envelope. According to an embodiment, the scattering particles may be arranged in a scattering layer at an inner surface of the envelope, whereby light intensity distribution of the lighting device may be tuned by varying the scattering properties of the scattering layer across the envelope. For example, the scattering layer may be provided with a pattern of openings (or holes), wherein portions of the envelope where less scattering is desired may be provided with more and/or larger openings in the scattering layer (or not any scattering layer at all) and portions of the envelope where more scattering is desired (such as in the upper portion) may be provided with smaller and/or fewer openings in the scattering layer. In an embodiment, the light intensity distribution of the lighting device may be tuned by varying the thickness of the scattering layer across the envelope. The scattering layer may then be thicker at the upper portion than at the lateral portion of the envelope.

According to another embodiment, the scattering particles may be embedded in the envelope, whereby reflection of light backwardly and laterally is obtained by volume scattering in the upper portion. For example, the envelope may be made of a light transmissive material, in which the scattering particles are embedded, wherein the local concentration of the scattering particles in the envelope and the local thickness of the envelope are adapted so as to form the redirecting upper portion.

In an embodiment, the concentration of the scattering particles in the envelope may be uniform (or homogenous), whereby the thickness of the envelope may be varied to tune the light intensity distribution of the lighting device and to form the redirecting upper portion of the envelope. The present embodiment is advantageous in that the envelope may be manufactured in a single piece of material, which e.g. may be a transparent material (such as glass or plastic) with scattering particles uniformly spread and embedded therein.

According to an embodiment of the present invention, the upper portion of the envelope may be thicker than a lateral portion of the envelope. For example, if the concentration of the scattering particles is uniform in the envelope, the upper portion may preferably be thicker than the lateral portion to provide higher (or more) scattering in the upper portion than in the lateral portion. According to another example, the upper portion may both be thicker and have a higher concentration of scattering particles than the lateral portion, whereby the light intensity in the lateral and backward directions is even more increased.

According to another embodiment of the present invention, the upper portion may be adapted to reflect a part of the light from the light source (laterally and backwardly) by means of total internal reflection (TIR), thereby reducing the need of scattering particles since the scattering properties of the upper portion are provided by means of TIR. In an embodiment, the upper portion may comprise prism-shaped elements for providing the TIR. The prism-shaped elements may e.g. be obtained by prism shaped grooves and ridges in the upper portion of the envelope, which grooves and ridges e.g. may be circumferentially, hexagonally or radially arranged (or arranged in any other appropriate way).

According to another embodiment of the present invention, the lighting device may be of tube-type or bulb-type. Accordingly, the envelope may be tube-shaped (or tube-shaped with a longitudinal opening at which the light sources, and any base to which the light sources are mounted, may be arranged) or bulb-shaped, respectively. In the present embodiments, the upper portion may be the portion of the bulb- or tube-shaped envelope arranged in front of the light source (i.e. in the main forward direction).

In an embodiment, the light source may be a solid state light source, such as an LED. Such light sources may provide a directed light with a higher light intensity forwardly than laterally and backwardly, which thus may be compensated by scattering a part of the light from the solid state light source laterally and backwardly via the upper portion of the envelope.

It is noted that the invention relates to all possible combinations of features recited in the claims. Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail with reference to the appended drawings showing embodiments of the invention.

FIG. 1A is a side view of a lighting device according to prior art.

FIG. 1B is a top view of the lighting device shown in FIG. 1A.

FIG. 6 shows a lighting device according to yet another embodiment of the present invention.

FIG. 7A shows a lighting device according to yet another embodiment of the present invention.

FIG. 7B is an enlarged view of a cross section of the lighting device shown in FIG. 7A.

Figure 2A:
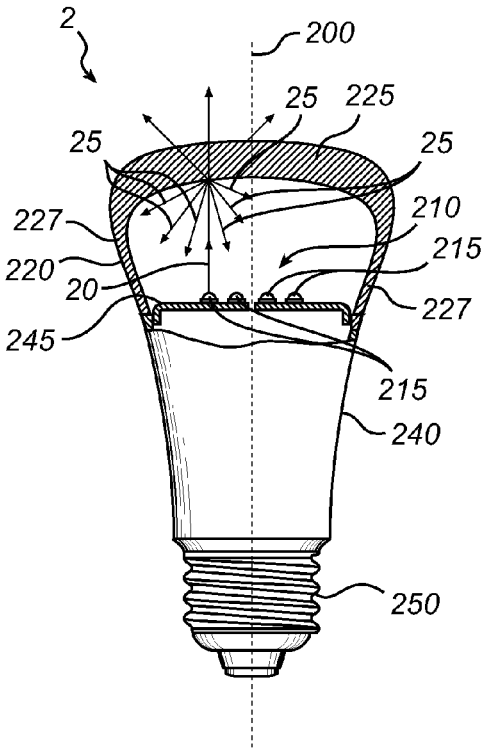
FIG. 2A shows a lighting device according to an embodiment of the present invention.

All the figures are schematic, not necessarily to scale, and generally only show parts which are necessary in order to elucidate the invention, wherein other parts may be omitted or merely suggested.

DETAILED DESCRIPTION

With reference to FIGS. 1A and 1B, a lighting device according to prior art will be described.

FIG. 1A shows a side view of a lighting device 1 comprising a light source 110 (including several LEDs) arranged at a horizontal base 145 and enclosed by a bulb shaped envelope 120. The light source 110 has a main forward emission direction 10 parallel to the optical axis 100 of the lighting device 1 and pointing away from the light source 110. In the upper portion of the envelope 120, a reflector 125 is arranged for reflecting light from the light source 110 laterally and backwardly in order to compensate for the shadowing effected caused by the base 145 on the light from the light source 110 laterally and backwardly. The reflector 125 however provides a dark area 126 at the top of the envelope 120, as illustrated in FIG. 1B showing the lighting device 1 from the top, which dark area 126 is a result of the reflector 125 reflecting almost 100% of the light from the light source 110. The dark area 126 deteriorates lighting device's 1 resemblance to a traditional incandescent light bulb, as well as the light intensity distribution in the near filed of the lighting device 1, as light is blocked in the main forward emission direction.

Figure 2B:
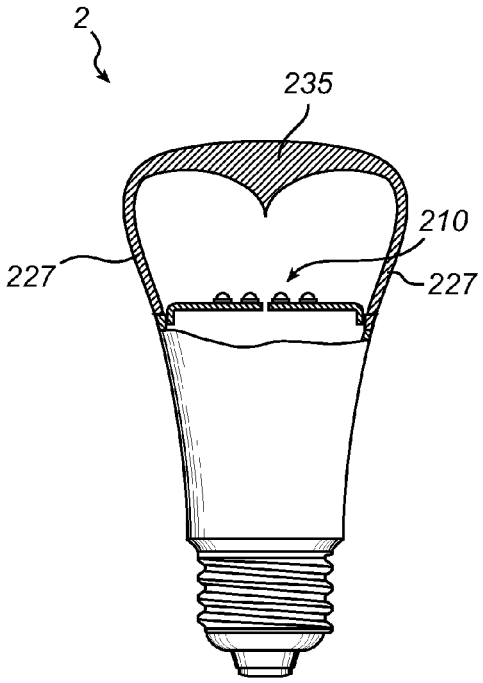
FIG. 2B shows a lighting device according to another embodiment of the present invention.

With reference to FIGS. 2A and 2B, a lighting device according to embodiments of the present invention will be described.

FIG. 2A shows a cross section of a lighting device 2 comprising a light source 210 including several LEDs 215 arranged at a base plate 245 and enclosed by a preferably bulb shaped envelope 220. The LEDs 215 have a main forward emission direction 20 substantially parallel to the optical axis 200 of the lighting device 2 and pointing away from the LEDs 215. The lighting device 2 may optionally comprise a screw base 250 for fitting the lighting device 2 in a lamp fitting, and a heat sink 240 for cooling the light source 210 and the electronics (not shown) used for driving the light source 210.

The envelope 220 comprises an upper portion 225 arranged in front of the light source 210 such that light emitted from the light source 210 substantially in the main forward emission direction 20 impinges on the upper portion 225. The envelope 220 further comprises a lateral portion (or sidewall) 227 arranged such that light emitted from the light source 210 substantially in the lateral direction impinges on the lateral portion 227. The upper portion 225 has scattering properties for reflecting a part of the impinging light laterally and backwardly (as illustrated by arrows 25), and transmitting a part of the impinging light out of the envelope 220. The reflection of light laterally and backwardly increases the light intensity of the lighting device 2 in the lateral and backward directions, while the transmission of light through the upper portion 225 still provides light emission from the lighting device 2 in the forward direction, which reduces the dark area obtained in the prior art (illustrated in FIG. 1B). Preferably, the upper portion 225 may be adapted such that at least 10%, or even more preferably, at least 25% of the light impinging on the upper portion is transmitted through the upper portion 225. A transmittance of 10% may be sufficient to significantly reduce the visibility of any dark area at the envelope 220, and a transmittance of 25% may give the appearance of a bulb that is fully lit. Further, the lateral portion 227 may be adapted to have a higher transmittance than the upper portion 225. For example, the lateral portion 227 may be adapted to transmit up to 80%, 90% or even almost 100% of impinging light. Optionally, the level of scattering in the upper portion 225 may gradually decrease towards the lateral portion 227 so as to provide a smooth transition between the upper portion 225 and the lateral portion 227.

The ratio of transmitted and backwardly reflected light depends on the amount of scattering in the upper portion 225 and the area of the upper portion 225. For obtaining a similar light intensity in the lateral and backward directions as in prior art using a reflector reflecting almost 100% of the light, the area of the upper portion 225 may be larger than the area of such reflector. For example, the upper portion 225 may cover approximately 25-50%, such as 40%, of the total envelope area. Another design parameter of the lighting device is the ratio between the diameter of the upper portion 225 (or the maximum envelope diameter) and the heat sink 240. The smaller the heat sink diameter is compared to the maximum envelope diameter, the more light is allowed to pass the heat sink in the lateral and backward directions and the less scattering in the upper portion is required to obtain a more uniform light intensity distribution. Hence, the scattering properties of the upper portion 225 may be adapted to design of the envelope and the size of the heat sink for providing a more uniform light intensity distribution. Yet another design parameter is the reflectivity of the heat sink. If the reflectivity is low, more light may preferably be reflected by the upper portion 225 to increase the amount of light impinging on the lateral portion 227 and hence, reflected laterally and backwardly. If the reflectivity is very high, less light needs to be reflected by the upper portion 225. For example, the design of the envelope (and the upper portion) and the heat sink may be adapted such that the upper portion transmits about 25%-50% of the light from the light source and the remainder of the light (except for light absorption loss) may emitted from the lateral portion.

In the present embodiments, the scattering properties are obtained by scattering particles embedded in the envelope 220, which may be referred to as volume scattering. The scattering particles may for instance be particles of titanium dioxide ($TiO_2$), which may be embedded in a transparent material (such as glass, plastic or silicone) forming the envelope 220. Preferably, also the lateral portion 227 may have scattering properties to reduce glare light from the light source 210. The light intensity distribution of the lighting device 2 may be tuned by spatially varying the scattering properties across the envelope 220 such that more scattering is obtained in the upper portion 225 than in the lateral portion 227. In the present embodiments, such tuning may be obtained by (spatially) varying the (wall) thickness of the envelope 220, such that portions where more scattering is desired are thicker than portions where less scattering is desired. For a given concentration of scattering particles, a thicker envelope wall includes more scattering particles per area unit than a thinner envelope wall. Tuning may also (as an alternative or complement) be obtained by (spatially) varying the concentration of scattering particles in the envelope such that portions where more scattering is desired have a higher concentration of scattering particles than portions where less scattering is desired. For a given envelope thickness, a portion with higher concentration of scattering particles includes more scattering particles per area unit than a portion with lower concentration. For example, the upper portion 225 may be thicker and/or have a higher concentration of scattering particles than the lateral portion 227. Further, in embodiments using scattering particles, the scattering properties may depend on the size of the particles and the relation between the size of the particles and the wavelength of the light from the light source 210.

Further, the shape of (in particular the inner surface) of the upper portion 225 may be adapted for influencing the beam angle of the laterally and backwardly reflected light. The lighting devices 2 illustrated in FIGS. 2A and 2B may be identical except for the shape of the upper portions 225, 235. In both embodiments, the upper portions 225, 235 of the envelope 220 are thicker than the lateral portion 227, so as to obtain more scattering in the upper portions 225, 235 than in the lateral portions 227. In the embodiment shown in FIG. 2A, the upper portion 225 has a (substantially) uniform thickness, which may be advantageous on a manufacturing point of view, as a less complex shape have to be manufactured. In the embodiment shown in FIG. 2B, the upper portion 235 has a cone (or tapered) shape extending from the top of the envelope towards the light source 210, which shape may be advantageous for obtaining increased light intensity laterally and backwardly. In particular, the light intensity is increased in the lateral directions, which is advantageous in that a higher optical efficiency is obtained, as less light is reflected against, or absorbed by, the base plate.

Figure 3A:
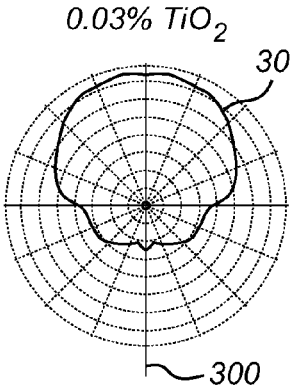
FIGS. 3A to 3E show the light intensity distribution of lighting devices according to different embodiments of the present invention.
Figure 3B:
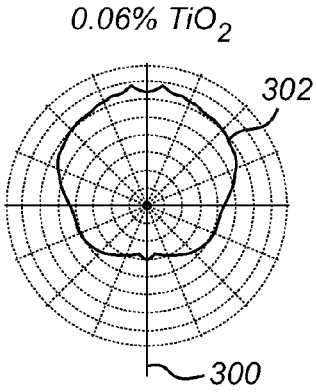
Figure 3C:
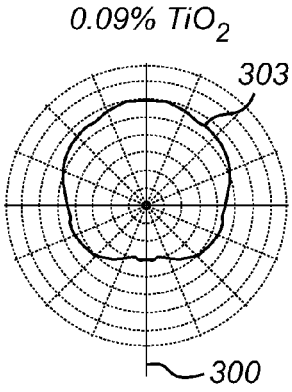
Figure 3D:
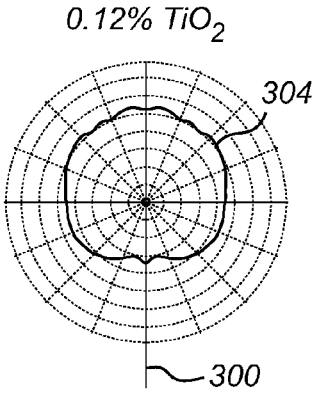
Figure 3E:
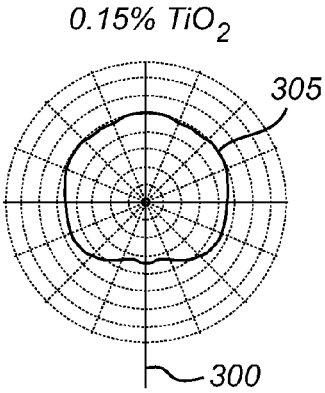

With reference to FIGS. 3A to 3E, a calculated light intensity distribution of a lighting device designed as described with reference to FIG. 2A will be described. In FIGS. 3A to 3E, the optical axis is denoted with reference sign 300 and the main forward emission direction is substantially parallel with the optical axis and points upwards in the figures. In the calculations, the concentration of scattering particles (in this case, $TiO_2$ particles) was varied from 0.03% up to 0.15% in the envelope 220. FIG. 3A shows the light intensity distribution 301 as obtained with a 0.03% concentration of scattering particles, FIG. 3B shows the light intensity distribution 302 as obtained with a 0.06% concentration of scattering particles, FIG. 3C shows the light intensity distribution 303 as obtained with a 0.09% concentration of scattering particles, FIG. 3D shows the light intensity distribution 304 as obtained with a 0.12% concentration of scattering particles, and FIG. 3E shows the light intensity distribution 305 as obtained with a 0.15% concentration of scattering particles. As can be seen in FIGS. 3A to 3E, the light intensity in the lateral and backward directions increases with an increased concentration of scattering particles, while the light intensity in the main forward emission direction slightly decreases.

Figure 4A:
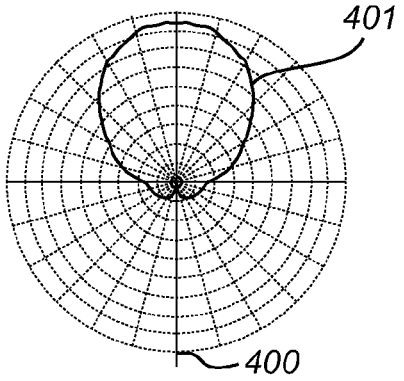
FIGS. 4A and 4B show the light intensity distribution of lighting devices according to different embodiments of the present invention.
Figure 4B:
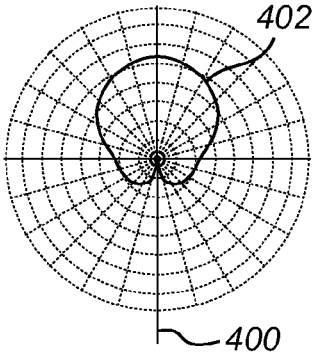

With reference to FIGS. 4A and 4B, a measured light intensity distribution of a lighting device designed as described with reference to FIG. 2A but with a uniform thickness of the envelope (i.e., the upper and lateral portions having the same thickness) will be described. In FIGS. 4A and 4B, the optical axis is denoted with reference sign 400 and the main forward emission direction is substantially parallel with the optical axis and points upwards in the figures. FIG. 4A shows the light intensity distribution 401 as obtained with a 0.015% concentration of $TiO_2$ scattering particles in the envelope and FIG. 4B shows the light intensity distribution 402 as obtained with a 0.12% concentration of $TiO_2$ scattering particles in the envelope. As can be seen in FIGS. 4A and 4B, the light intensity in the lateral and backward directions (relative to the main forward emission direction) is slightly higher for the lighting device having higher concentration of scattering particles.

Figure 5A:
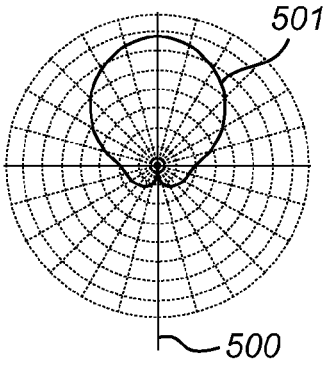
FIGS. 5A and 5B show the light intensity distribution of lighting devices according to different embodiments of the present invention.
Figure 5B:
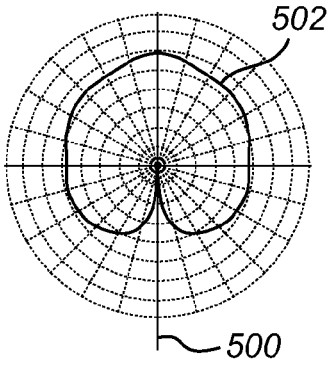

With reference to FIGS. 5A and 5B, a measured light intensity distribution of a lighting device designed as described with reference to FIG. 2A (i.e., the upper portion being thicker than the lateral portion) will be described. In FIGS. 5A and 5B, the optical axis is denoted with reference sign 500 and the main forward emission direction is parallel with the optical axis and points upwards in the figures. FIG. 5A shows the light intensity distribution 501 as obtained with a 0.015% concentration of $TiO_2$ scattering particles in the upper portion and FIG. 5B shows the light intensity distribution 502 as obtained with a 0.12% concentration of $TiO_2$ scattering particles in the upper portion. As can be seen in FIGS. 5A and 5B, the light intensity in the lateral and backward directions (relative to the main forward emission direction) is significantly higher for the lighting device having higher concentration of scattering particles. Further, comparing the light intensity distribution illustrated in FIG. 4B with the light intensity distribution illustrated in FIG. 5B shows that the light intensity in the lateral and backward directions (relative to the main forward emission direction) is significantly higher if the upper portion both is thicker and has a higher concentration of scattering particles than the lateral portion.

With reference to FIG. 6, a lighting device according to another embodiment of the present invention will be described. The basic structure and operation principle of the lighting device described with reference to FIG. 6 may be identical to the basic structure and operation principle of the lighting device described with reference to FIG. 2A, except that the scattering properties are obtained by surface scattering, which will be described in the following.

FIG. 6 shows a lighting device 6 comprising a light source 610 including several LEDs 615 enclosed by an envelope 620 having an upper portion 625 and lateral portions 627. In the present embodiment, scattering particles (such as $TiO_2$ particles) are provided in a layer 621 at the inner surface of the envelope 620, such that the scattering properties of the upper portion 625 are obtained by surface scattering. The scattering layer 621 comprises a pattern of dots with scattering particles. However, the scattering layer 621 may have any appropriate pattern comprising scattering fields and non-scattering fields. The scattering properties of the scattering layer may be tuned by varying the density (or area) and/or thickness of the scattering fields in the pattern. In the present example, the lateral portion 627 of the envelope 620 is not provided with any scattering layer, whereby the scattering is higher in the upper portion 625 than in the lateral portion 627. However, the scattering layer 621 may alternatively extend down at the lateral portions 627, wherein the thickness and/or density of the scattering layer may be lower in the lateral portion 627 than in the upper portion 625 for obtaining a lower scattering. According to another example, a scattering layer (without any pattern) may be applied on the upper portion and the lateral portion, wherein the scattering layer may be thicker at the upper portion than at the lateral portion. For example, with reference to FIG. 6, the patterned upper portion 625 may instead of being patterned, have a uniform scattering layer applied on the inside (and/or the outside), and the lateral portion 627 may also have a (uniform) scattering layer applied on the inside (and/or the outside), wherein the scattering layer at the lateral portion 627 is thinner than the scattering layer at the upper portion 625.

In an embodiment, the lighting device 6 may comprise an additional optical part 660 having an upper portion 665 adapted to reflect some of the light from the light source 610 in the lateral and backward directions (relative to the main forward emission direction). The upper portion 665 of the optical part 660 may thus provide a similar effect as the upper portion 625 of the envelope 620, and provide additional redirection of light in the lateral and backward directions. The upper portion 665 of the additional optical part 660 may have scattering properties, which may provided by e.g. volume scattering or surface scattering as described above, or by total internal reflection (which will be described further on). For example, the optical part 660 may be dome shaped. It will be appreciated that the present embodiment may be combined with any of the other described embodiments. Optionally, the lighting device 6 (or any of the previously described lighting devices) may comprise a filter, e.g. arranged in the additional optical portion 660, for tuning the color of the lighting device 6, e.g. by means of phosphor.

With reference to FIGS. 7A and 7B, a lighting device according to another embodiment of the present invention will be described. The basic structure and operation principle of the lighting device described with reference to FIGS. 7A and 7B may be identical to the basic structure and operation principle of the lighting device described with reference to FIG. 2A, except that the scattering properties are obtained by total internal reflection (TIR), which will be described in the following.

FIG. 7A shows a lighting device 7 comprising a light source 710 including several LEDs 715 enclosed by an envelope 720 having an upper portion 725 and a lateral portion 727. In the present embodiment, the upper portion 725 is provided with prism-shaped elements 729 (also illustrated in FIG. 7B showing an enlarged view of the upper portion 725), such that the scattering properties of the upper portion 725 are obtained by TIR. As an example, a light beam A from the light source 710 impinging at the upper portion 725 hits the prism-shaped elements 729 with an angle causing the light beam A to be reflected by the boundary between the envelope and the surrounding air, such that the beam A is reflected in the lateral and downward direction. Another light beam B from the light source 710 hits the prism-shaped elements 729 with an angle causing the light beam B to be transmitted (instead of reflected) through the upper portion 725. The prism-shaped elements 729 may be arranged in any appropriate a pattern, such as an annular (circumferential), hexagonal or radial pattern. Optionally, the envelope 720 may comprise an outer (preferably transparent) cover 728 protecting the prism-shaped elements 729 from damage.

Figure 8A:
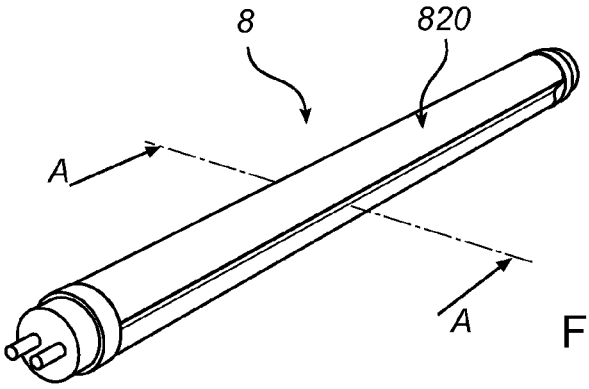
FIG. 8A shows a tube-type lighting device according to an embodiment of the present invention.
Figure 8B:
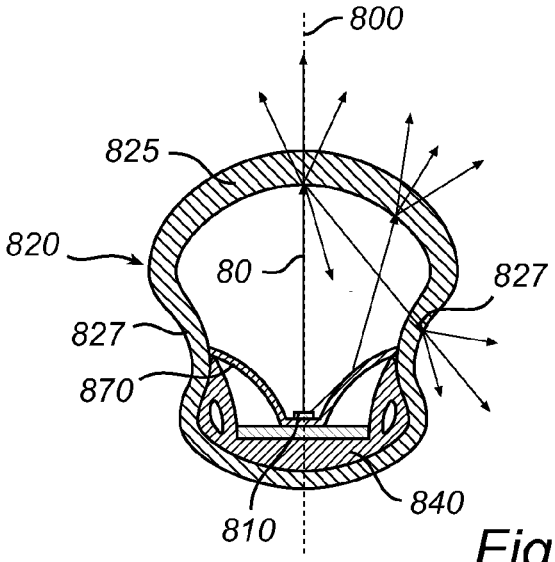
FIG. 8B shows a cross section taken along line A-A of the lighting device shown in FIG. 8A.

With reference to FIGS. 8A and 8B, a lighting device according to another embodiment of the present invention will be described. The basic structure and operation principle of the lighting device described with reference to FIGS. 8A and 8B may be the same as the basic structure and operation principle of the lighting device described with reference to FIG. 2A, except that the lighting device is of tube-type.

FIGS. 8A and 8B show a tube-type lighting device 8 comprising a tube shaped envelope 820 enclosing a light source 810 including several LEDs having a main forward emission direction 80 along an optical axis 800 (as illustrated in FIG. 8B showing a cross section taken along line A-A in FIG. 8A). Preferably, a heat sink 840 is arranged adjacent to the light source 810 and a reflector 870 is arranged to cover the heat sink 840 and reflect light from the light source 810 out of the envelope 820. Further, the envelope 820 comprises an upper portion 825 having scattering properties and arranged to reflect a part of the light from the light source 810 laterally and backwardly. The scattering properties may e.g. be obtained by volume scattering, surface scattering, TIR as described above, or any combination thereof. Preferably, the envelope 820 may be adapted such that more scattering is obtained in the upper portion 825 than in the lateral portion 827.

Figure 8C:
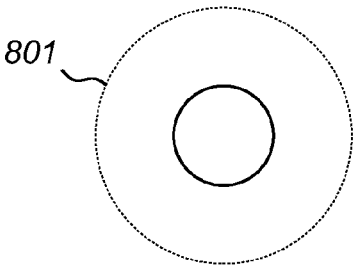
FIG. 8C shows the light intensity distribution of a neon tube lighting device according to prior art.
Figure 8D:
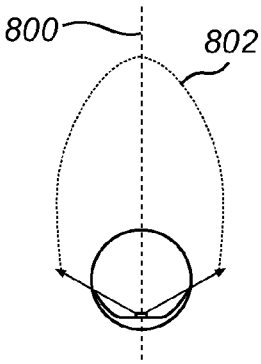
FIG. 8D shows the light intensity distribution of an LED tube lighting device according to prior art.
Figure 8E:
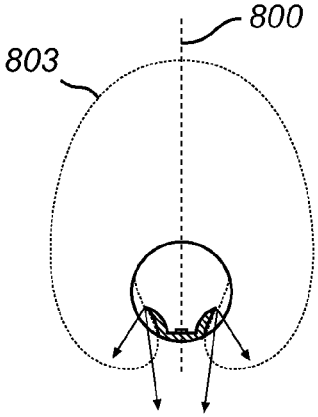
FIG. 8E shows the light intensity distribution of the lighting device shown in FIG. 8A.

With reference to FIGS. 8C to 8E, the light intensity distribution of prior art tube-type lighting devices and of the lighting device 8 according to the present embodiment will be described. In the FIGS. 8C to 8E, the optical axis of the lighting devices are denoted with reference sign 800, and the main forward emission direction is substantially parallel with the optical axis and points upwards in the figures. FIG. 8C shows the light intensity distribution 801 of a neon (or fluorescent) tube-type lighting device according to prior art. The light intensity distribution 801 is uniform around the periphery of the tube. FIG. 8D shows the light intensity distribution 802 of an LED tube-type lighting device according to prior art (i.e. without any upper scattering portion). The light intensity distribution 802 is higher in the main forward emission direction of the LEDs, but lower in the lateral directions and zero in the backward directions. The low lateral and backward light intensity is mainly caused by the heat sink (which is necessary for cooling the LEDs) shadowing the light from the LEDs in the lateral and backward directions. FIG. 8E shows the light intensity distribution 803 of an LED tube-type lighting device according the present embodiment. As can be seen when comparing FIGS. 8C to 8E, the light intensity distribution 803 of the present embodiment is significantly higher laterally and backwardly, and thereby more uniform (and more omnidirectional), compared to the conventional LED tube-type lighting device, and better resembles the light intensity distribution 801 of a traditional neon (or fluorescent) tube-type lighting device.

Figure 9:
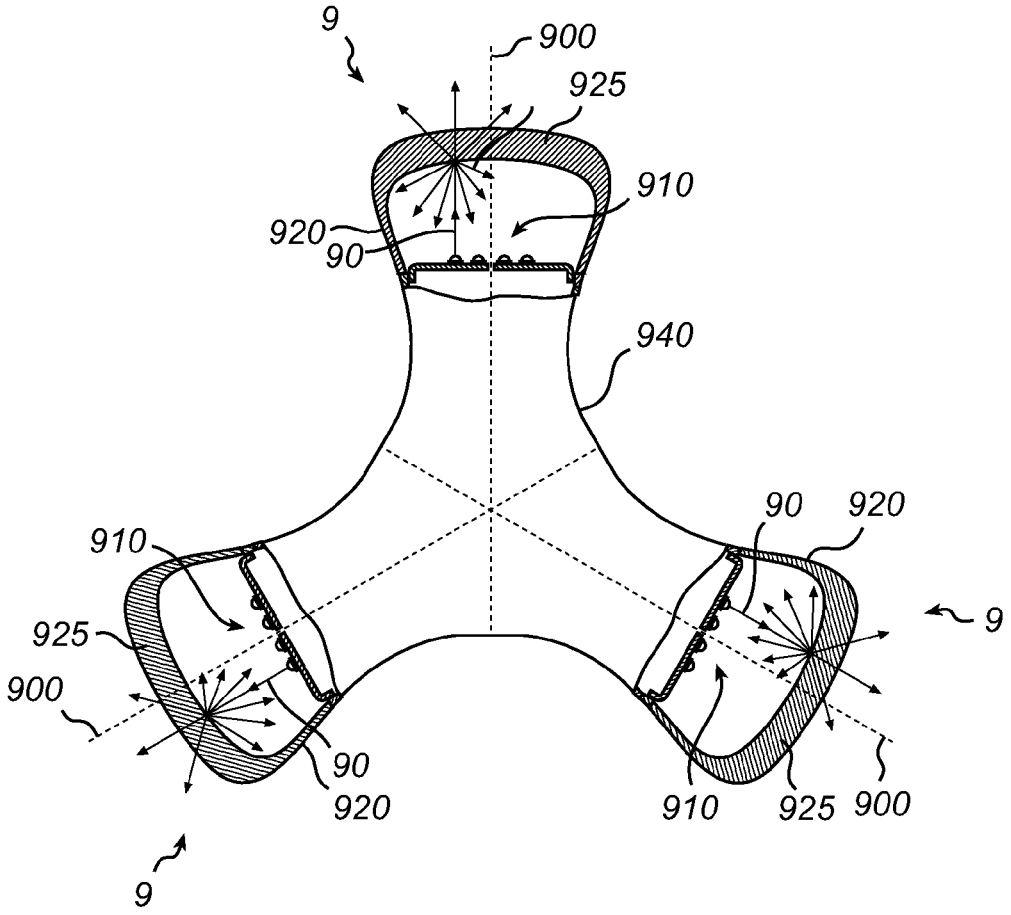
FIG. 9 shows a lighting device according to an embodiment of the present invention.

Furthermore, the lighting device may be an LED module (having the features defined in the independent claim). Several such LED modules 9 may be interconnected to a luminary, as shown in FIG. 9. Preferably, the LED 9 modules may be arranged such that the forward emission directions 90 of the LED modules 9 are in different directions. For example, a common heat sink 940 may interconnect the LED modules 9. Each LED module may comprise a light source 910 having a main forward emission direction 90 (parallel with the optical axis 900 of the light source 910), and an envelope 920 in which the light source 910 is arranged. The envelope 920 comprises an upper portion 925 having scattering properties and being arranged to reflect a part of the light from the light source 910 laterally and backwardly relative to the main forward emission direction 90 and transmit a part of the light from the light source 910.

ITEMIZED LIST OF EMBODIMENTS

1. A lighting device comprising a light source and an envelope having a wall thickness and a top part, said envelope having an inner surface provided with scattering properties which redirect at least part of the light impinging on said top part in a substantial downward direction and transmit the remainder of the light, therewith a homogeneous light distribution is obtained.

2. The lighting device according to item 1, wherein the scattering properties are obtained by providing the wall with a concentration of scattering particles.

3. The lighting device according to item 1 or 2, wherein said scattering properties are varied by varying the wall thickness of the envelope.

4. The lighting device according to item 1, 2 or 3, wherein the concentration of scattering particles is kept constant over the wall.

5. The lighting device according to item 1, 2 or 3, wherein the concentration of scattering particles is increased on the top part.

6. The lighting device according to any of the preceding items, characterized in that the envelope transmits at least 10% of its light through the top part.

The person skilled in the art realizes that the present invention by no means is limited to the preferred embodiments described above. On the contrary, many modifications and variations are possible within the scope of the appended claims. It will be appreciated that the embodiments described with reference to FIGS. 2A and 2B, in particular the embodiments relating to transmittance of the upper portion and gradual transition of the scattering properties of the upper portion, may be applied in any of the other embodiments of the present invention. Further, the embodiments of surface scattering, volume scattering and total internal reflection may be combined in any appropriate way.

The invention claimed is:

1. A lighting device comprising:

a light source having a main forward emission direction, and an envelope in which the light source is arranged, wherein the envelope comprises an upper portion having scattering properties and being arranged to reflect a part of the light from the light source laterally and backwardly relative to said main forward emission direction and transmit a part of the light from the light source, wherein scattering particles are embedded in the envelope, and the envelope comprises an upper portion and a lateral portion, wherein the upper portion of the envelope is thicker than the lateral portion of the envelope.

2. The lighting device as defined in claim 1, wherein the envelope is adapted such that scattering of light is higher in the upper portion than in the lateral portion of the envelope.

3. The lighting device as defined in claim 1, wherein the upper portion has a transmittance of at least 10%, preferably at least 25%, and even more preferably at least 50%.

4. The lighting device as defined in claim 3, wherein the scattering properties of the upper portion gradually decrease towards the lateral portion of the envelope.

5. The lighting device as defined in claim 4, wherein the scattering particles are arranged at an inner surface of the envelope.

6. The lighting device as defined in claim 5 wherein the scattering particles are arranged in a scattering layer at the inner surface of the envelope.

7. The lighting device as defined in claim 6, wherein the scattering layer is thicker at the upper portion than at the lateral portion of the envelope.

8. The lighting device as defined in claim 1, wherein the concentration of the scattering particles in the envelope is uniform.

9. The lighting device as defined in claim 1, wherein the upper portion is adapted to reflect a part of the light from the light source by means of total internal reflection.

10. The lighting device as defined in claim 9 wherein the upper portion comprises prism-shaped elements for providing said total internal reflection.

11. The lighting device as defined in claim 1, wherein the lighting device is of tube-type or bulb-type.

* * * * *